US007624566B1

(12) United States Patent
Manzella et al.

(10) Patent No.: US 7,624,566 B1
(45) Date of Patent: Dec. 1, 2009

(54) MAGNETIC CIRCUIT FOR HALL EFFECT PLASMA ACCELERATOR

(75) Inventors: David H. Manzella, Cleveland, OH (US); David T. Jacobson, Lakewood, OH (US); Robert S. Jankovsky, Brunswick, OH (US); Richard Hofer, Ypsilanti, MI (US); Peter Peterson, Brunswick, OH (US)

(73) Assignee: The United States of America as represented by the Administrator of National Aeronautics and Space Administration, Washington, DC (US)

( * ) Notice: Subject to any disclaimer, the term of this patent is extended or adjusted under 35 U.S.C. 154(b) by 615 days.

(21) Appl. No.: 11/040,304

(22) Filed: Jan. 18, 2005

(51) Int. Cl.
*H05H 1/00* (2006.01)
*B63H 11/00* (2006.01)

(52) U.S. Cl. ..... 60/202; 60/204

(58) Field of Classification Search ..... 60/202, 60/204, 203.1, 200.1, 310, 376, 219
See application file for complete search history.

(56) References Cited

U.S. PATENT DOCUMENTS

| | | | |
|---|---|---|---|
| 3,983,695 | A | 10/1976 | Power |
| 4,011,719 | A | 3/1977 | Banks |
| 4,298,817 | A | 11/1981 | Carette et al. |
| 4,825,646 | A | 5/1989 | Challoner et al. |
| 4,862,032 | A | 8/1989 | Kaufman et al. |
| 5,218,271 | A | 6/1993 | Egorov et al. |
| 5,359,258 | A | 10/1994 | Arkhipov et al. |
| 5,475,354 | A | 12/1995 | Valentian et al. |
| 5,581,155 | A | 12/1996 | Morozov et al. |
| 5,646,476 | A | 7/1997 | Aston |
| 5,763,989 | A | 6/1998 | Kaufman |
| 5,798,602 | A | 8/1998 | Gopanchuk et al. |
| 5,838,120 | A | 11/1998 | Semenkin et al. |

(Continued)

FOREIGN PATENT DOCUMENTS

| | | | |
|---|---|---|---|
| DE | 198 28 704 | A1 | 6/1998 |

(Continued)

OTHER PUBLICATIONS

Richard R. Hofer et al., "Ion Voltage Diagnostics in the Far-Field Plume of a High-Specific Impulse Hall Thruster," 39th AIAA/ASME/SAE/ASEE Joint Propulsion Conference, Jul. 20-23, 2003.

(Continued)

*Primary Examiner*—Michael Cuff
*Assistant Examiner*—Gerald L Sung
(74) *Attorney, Agent, or Firm*—Robert H. Earp, III; Alicia M. Choi; Sheetal S. Patel

(57) ABSTRACT

A Hall effect plasma accelerator includes inner and outer electromagnets, circumferentially surrounding the inner electromagnet along a thruster centerline axis and separated therefrom, inner and outer magnetic conductors, in physical connection with their respective inner and outer electromagnets, with the inner magnetic conductor having a mostly circular shape and the outer magnetic conductor having a mostly annular shape, a discharge chamber, located between the inner and outer magnetic conductors, a magnetically conducting back plate, in magnetic contact with the inner and outer magnetic conductors, and a combined anode electrode/gaseous propellant distributor, located at a bottom portion of the discharge chamber. The inner and outer electromagnets, the inner and outer magnetic conductors and the magnetically conducting back plate form a magnetic circuit that produces a magnetic field that is largely axial and radially symmetric with respect to the thruster centerline.

19 Claims, 2 Drawing Sheets

U.S. PATENT DOCUMENTS

| | | | |
|---|---|---|---|
| 5,845,880 | A | 12/1998 | Petrosov et al. |
| 5,847,493 | A | 12/1998 | Yashnov et al. |
| 5,892,329 | A | 4/1999 | Arkhipov et al. |
| 5,924,277 | A | 7/1999 | Beattie et al. |
| 5,945,781 | A | 8/1999 | Valentian |
| 6,075,321 | A | 6/2000 | Hruby |
| 6,158,209 | A | 12/2000 | Latischev et al. |
| 6,208,080 | B1 | 3/2001 | King et al. |
| 6,215,124 | B1 | 4/2001 | King |
| 6,449,941 | B1 | 9/2002 | Warboys et al. |
| 6,456,011 | B1 | 9/2002 | Bugrova et al. |
| 6,525,480 | B1 | 2/2003 | Hargus, Jr. et al. |
| 6,612,105 | B1 | 9/2003 | Voigt et al. |
| 6,640,535 | B2 | 11/2003 | Gallimore et al. |
| 2002/0008455 | A1 | 1/2002 | Fisch et al. |
| 2002/0116915 | A1 | 8/2002 | Hruby et al. |
| 2002/0145389 | A1 | 10/2002 | Bugrova et al. |
| 2002/0194833 | A1 | 12/2002 | Gallimore et al. |
| 2003/0048053 | A1 | 3/2003 | Kornfeld et al. |
| 2003/0057846 | A1 | 3/2003 | Kornfeld et al. |
| 2006/0010851 | A1 * | 1/2006 | Cagan et al. ..... 60/202 |

FOREIGN PATENT DOCUMENTS

| | | | |
|---|---|---|---|
| EP | 0 982 976 | A1 | 1/2000 |
| FR | 2842261 | A1 * | 1/2004 |

OTHER PUBLICATIONS

Richard R. Hofer et al., "Ion Species Fractions in the Far-Field Plume of a High-Specific Impulse Hall Thruster," 39$^{th}$ AIAA/ASME/SAE/ASEE Joint Propulsion Conference, Jul. 20-23, 2003.

Richard R. Hofer et al., "The Influence of Current Density and Magnetic Field Topography in Optimizing the Performance, Divergence, and Plasma Oscillations of High Specific Impulse Hall Thrusters," NASA/TM—2003-212605, IEPC-2003-142.

Richard R. Hofer et al., "Recent Results from Internal and Very-Near-Field Plasma Diagnostics of a High Specific Impulse Hall Thruster," NASA/CR-2003-212604, IEPC-2003-037.

* cited by examiner

MAGNETIC CIRCUIT FOR HALL EFFECT PLASMA ACCELERATOR

ORIGIN OF THE INVENTION

The invention described herein was made by employees of the United States Government and may be manufactured and used by or for the Government for Government purposes without payment of any royalties thereon or therefore.

BACKGROUND OF THE INVENTION

1. Field of Invention

This invention relates to Hall thrusters that are used in propulsion systems. Specifically, this invention relates to systems and methods that allow for the improvements to Hall thrusters.

2. Description of Related Art

Hall effect plasma accelerators have received substantial scrutiny by the engineering community due to their unique capability for efficiently producing high energy plasma beams that can be used for space propulsion or for terrestrial material processing applications. Hall effect plasma accelerators, or Hall thrusters, as they are commonly referred, rely on an annular ceramic discharge channel in which plasma is ionized and accelerated. The plasma is accelerated by the combined operation of electric and magnetic fields applied in the coaxial channel.

More specifically, Hall effect plasma accelerators rely on a magnetic field established across an annular dielectric discharge chamber and a working fluid, typically gaseous xenon, which is introduced at the rear of the annular discharge chamber through an anode-gas distributor. A plasma discharge is established by applying a voltage between the anode-gas distributor and an external cathode. The magnetic field is used to impede the flow of electrons from an external cathode to the anode allowing electric field strengths sufficient to produce high ion energies (typically 200-1000 Volts). Hall effect plasma accelerators provide high jet velocities, in the range of 10 km/s to 20 km/s, with current densities, about 0.1 A/cm$^2$. The input power levels for most thrusters are in the general range of 0.5 kW to 10 kW.

While most Hall thrusters retain the same basic design, the specific details vary with the nominal operating parameters, such as the working gas, the gas flow rate and the discharge voltage. The general design parameters that are varied to meet specific requirements include the discharge channel geometry, the material for that channel, and the magnetic field distribution. The discharge channel is typically made of boron nitride, but other compositions are possible.

One or more magnetic sources, in a Hall effect plasma accelerator, in a particular arrangement form a magnetic circuit. In prior art Hall effect plasma accelerators, magnetic fields are produced that are substantially radial. These magnetic fields allow for the erosion of the dielectric discharge chamber by the high energy ions contained within it. Ultimately, this results in erosion of the surrounding magnetic system.

The operational lifetime of the accelerator is defined by the amount of time the accelerator can operate before the magnetic system is exposed to the plasma within the channel. The lifetime of state-of-the-art accelerators is on the order of 10,000 hours. Thus, if there is a means of ensuring that the magnetic system is not exposed by erosion of the ceramic discharge channel, then the useful lifetime of an accelerator can be extended.

Several methods have been employed in the prior art to increase Hall thruster lifetime. Attempts have been made to identify and incorporate discharge chamber materials with high resistance to erosion. Prior techniques for extending operational lifetime include increasing the thickness of the discharge channel material, magnetically shielding the discharge channel material from the plasma, and controlling the energy of the plasma interacting with the discharge channel.

However, none of the prior techniques implemented have eliminated the life limiting mechanism of Hall thrusters. Additionally, some of the prior techniques introduced negative effects on thruster performance. Thus, there is a need in the prior art to have Hall thrusters with increased usable lifetimes.

SUMMARY OF THE INVENTION

According to one embodiment of the invention, a Hall effect plasma accelerator includes inner and outer electromagnets, with the outer electromagnet circumferentially surrounding the inner electromagnet along a thruster centerline axis and separated therefrom, inner and outer magnetic conductors, in physical connection with their respective inner and outer electromagnets, with the inner magnetic conductor having a mostly circular shape and the outer magnetic conductor having a mostly annular shape, a discharge chamber, located between the inner and outer magnetic conductors, a magnetically conducting back plate, in magnetic contact with the inner and outer magnetic conductors and securing the relative positions of the inner and outer electromagnets, inner and outer magnetic conductors and the discharge chamber and a combined anode electrode/gaseous propellant distributor, located at a bottom portion of the discharge chamber. The inner and outer electromagnets, the inner and outer magnetic conductors and the magnetically conducting back plate form a magnetic circuit that produces a magnetic field that is largely axial and radially symmetric with respect to the thruster centerline.

The inner magnetic conductor may include a magnetic conducting core and an inner pole and the outer magnetic conductor may include an outer conducting cylindrical portion located adjacent to the outer electromagnets and an outer pole. Additionally, the inner magnetic conductor may also include an inner annular portion and the outer magnetic conductor may also include an outer annular portion, where the inner and outer annular portions abut an outer surface of the discharge chamber.

Also, the discharge chamber may include an annular trough formed from boron nitride. Additionally, the magnetic field may be sufficient to impede transverse motion of plasma toward the walls of the discharge chamber during operation of the Hall effect plasma accelerator. Also, the magnetic field may be sufficient to minimize plasma energy losses to the walls of the discharge chamber.

According to another embodiment, a process for operating a Hall effect plasma accelerator is disclosed. The Hall effect plasma accelerator has an annular discharge chamber in contact with and separating inner and outer magnetic circuit portions, with the inner magnetic circuit portion, the discharge chamber, and the outer magnetic circuit portion being circumferentially arranged around a thruster centerline axis, and the inner and outer the magnetic circuit portions forming a magnetic circuit. The process includes the steps of receiving propellant gas through a combined anode electrode/gaseous propellant distributor into the discharge chamber, forming a plasma in the discharge chamber using the propellant gas and shaping the formed plasma through a magnetic field produced by the magnetic circuit. The magnetic circuit produces a magnetic field that is largely axial and radially symmetric with respect to the thruster centerline.

According to another embodiment, a Hall effect plasma accelerator includes annular discharge chamber means for receiving propellant gas and forming a plasma using the propellant gas and magnetic circuit means for shaping the formed plasma through a magnetic field produced by the magnetic circuit means. The magnetic circuit means includes inner and outer the magnetic circuit portions in contact with the annular discharge chamber means, with the annular discharge chamber means separating the inner and outer magnetic circuit portions, with the inner magnetic circuit portion, the discharge chamber, and the outer magnetic circuit portion being circumferentially arranged around a thruster centerline axis. The magnetic field produced is largely axial and radially symmetric with respect to the thruster centerline.

These and other variations of the present invention will be described in or be apparent from the following description of the preferred embodiments.

BRIEF DESCRIPTION OF THE DRAWINGS

For the present invention to be easily understood and readily practiced, the present invention will now be described, for purposes of illustration and not limitation, in conjunction with the following figures.

DETAILED DESCRIPTION OF PREFERRED EMBODIMENTS

By using a magnetic circuit according to the present invention, a Hall effect plasma accelerator can be constructed that offers advantages with regard to performance, beam symmetry, and lifetime relative to conventional magnetic devices. This magnetic circuit minimizes the flux of energetic particles to the discharge chamber walls improving accelerator lifetime and operational efficiency. The symmetry properties of this magnetic circuit ensures the plasma produced by the Hall effect plasma accelerator will be symmetric even if the mass of the magnetic circuit is minimized.

The present invention is directed, at least in part, to a magnetic circuit that utilizes two concentric electromagnets to produce an axial and radial magnetic field across the gap of the annular dielectric discharge chamber. This magnetic circuit design reduces the flux of energetic particles to the walls, improving performance and increased operational lifetime.

The magnetic circuit is composed of an inner electro-magnet surrounding the inner core of the magnetic circuit and an outer electromagnet that does not enclose a magnetic conductor. Both electromagnets are operated with the same electrical and magnetic polarity. The inner and outer magnetic conductors are magnetically coupled through the use of a magnetically conducting back plate. The magnetic field produced by this circuit is both axial and radial. The axial nature of the magnetic field shields the annular dielectric discharge chamber from plasma, thus increasing performance and extending operation lifetime.

Figure 1:
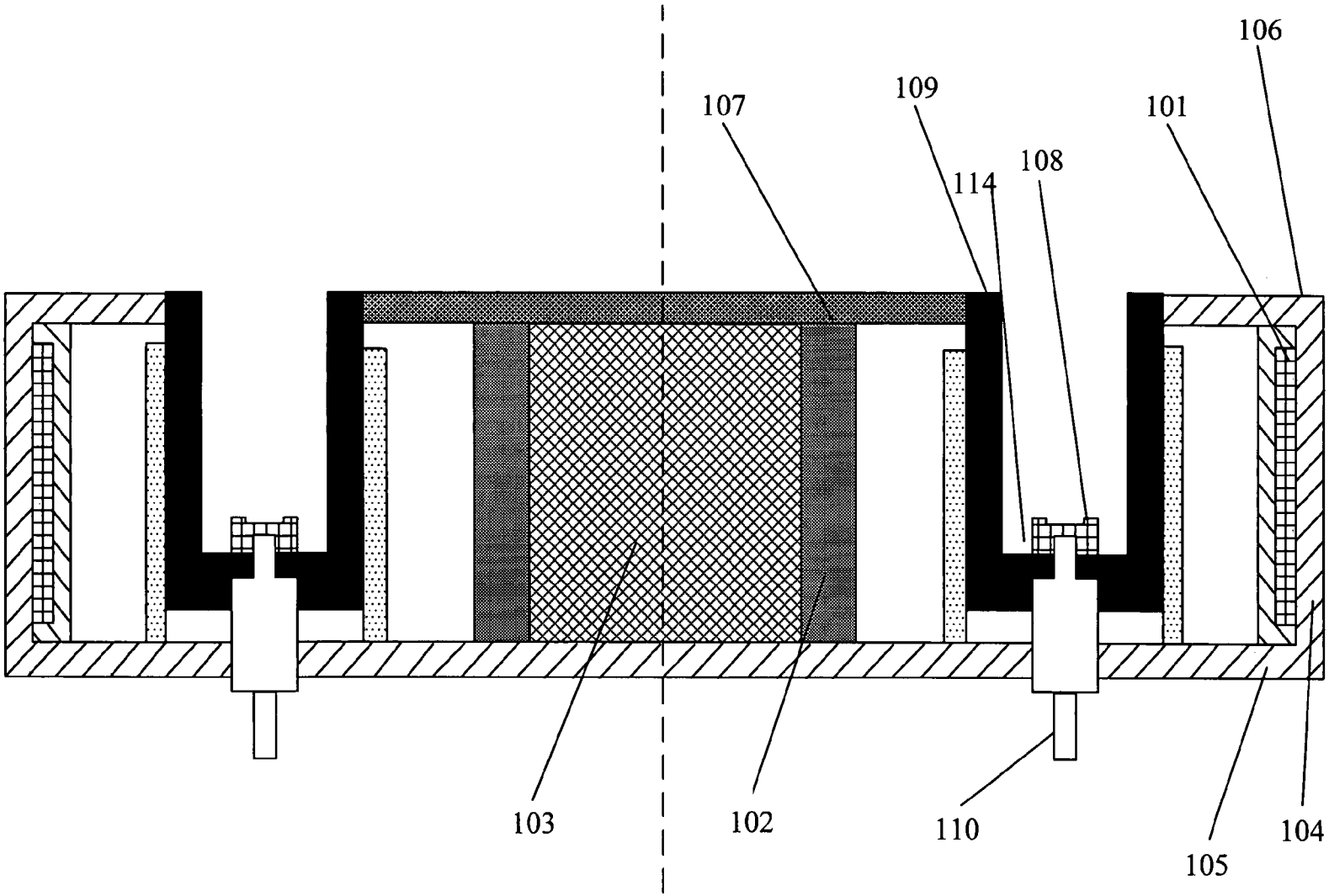
FIG. 1 is a cross sectional view of a Hall thruster, according to several embodiments of the present invention.

One such exemplary Hall effect plasma accelerator, using the above-discussed magnetic circuit, is illustrated in FIG. 1. The accelerator is generally circular or cylindrical in structure, and is generally symmetric about a central axis. Such an axis is illustrated by the dashed line in FIG. 1 and while elements on the right-hand side of the schematic are described, such elements are also found on the left-hand side of the cross-section illustrated in FIG. 1. The accelerator includes an outer electromagnet 101 and an inner electromagnet 102. The accelerator also includes inner and outer magnetic conductors, 103 and 104, respectively, supported by a magnetically conducting back plate 105. The accelerator also includes an outer pole 106 and an inner pole 107, protected from plasma exposure by a discharge chamber 109. Inside the discharge chamber is a combination anode-gas distributor 108 that acts to distribute anode gases provided by a gas nozzle propellant line 110. Also, the discharge chamber may include an annular trough 114 formed from boron nitride.

As discussed above, the magnetic circuit employs two coaxial electromagnets, 101 and 102. The outer electromagnet, 101, is situated between the outer magnetic conductor 104 and the outer wall of the annular dielectric discharge chamber, 109. The inner electromagnet 102 surrounds an inner magnetic conductor 103 and is located between that inner magnetic conductor and the inner wall of the annular dielectric discharge chamber. The inner electromagnet is in the path of the magnetic circuit. The outer electromagnet is not in the path of the magnetic circuit. Both electromagnets are operated with the same electric and magnetic polarity. Both inner and outer magnetic conductors are connected by a magnetically conducting back plate, 105. The magnetic field provided by the electromagnets are not magnetically independent. The advantages of this magnetic circuit are its inherent cylindrical symmetry, which is required for an azimuthally uniform plasma. A azimuthally uniform plasma is optimal for obtaining long life or for plasma processing applications, as discussed above.

The magnetic circuit provides both substantially radial and axial magnetic fields. By employing a substantial axial magnetic field component it is possible to shield the plasma from the walls of the annular dielectric discharge chamber. This magnetic shielding is enabled by an axial field strength, sufficient to impede the transverse motion of electrons towards the discharge chamber in the vicinity of the discharge chamber walls. The advantages of this magnetic field configuration are that it minimizes the interaction between the plasma and the annular dielectric discharge chamber walls. Minimizing this interaction improves the efficiency of the discharge by minimizing energy losses to the discharge chamber and increases the lifetime of the discharge chamber by reducing the collisions of energetic ions with the discharge chamber.

Figure 2:
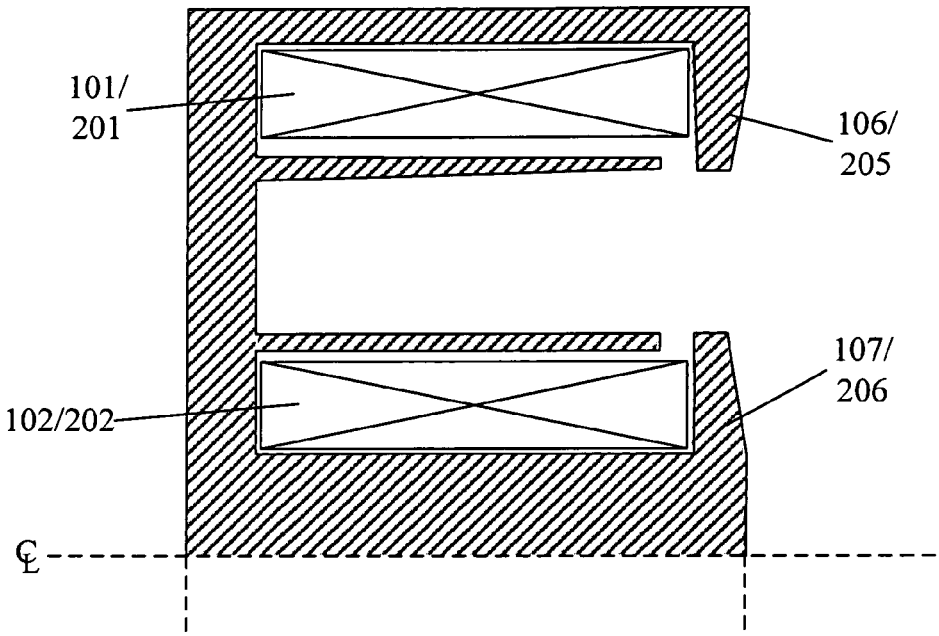
Fig. 2 PRIOR ART
FIG. 2 provides an explanatory diagram illustrating a portion of the magnetic circuit of a Hall effect plasma accelerator, according to at least one embodiment of the present invention.

Another view of the section of an exemplary Hall effect plasma accelerator is shown in FIG. 2, where only a portion of the accelerator to the left of the centerline is illustrated. It should be understood that the accelerator is cylindrically symmetric about that centerline. A single cylindrical outer electromagnet 201 is in one part and a single cylindrical inner electromagnet 202 is in another part. The shaded section makes up the magnetic circuit, and is formed from iron, HIPERCO™, or other magnetically conductive material. As illustrated, an outer pole 205 and an internal pole 206 is shown.

Figure 3:
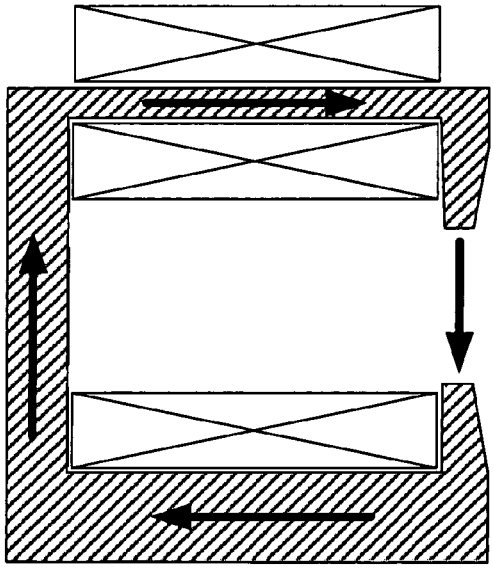
FIG. 3 provides a schematic illustrating a magnetic circuit used in prior art Hall effect plasma accelerators in which the outer electromagnet(s) are surrounding the outer magnetic conductor.
Figure 4:
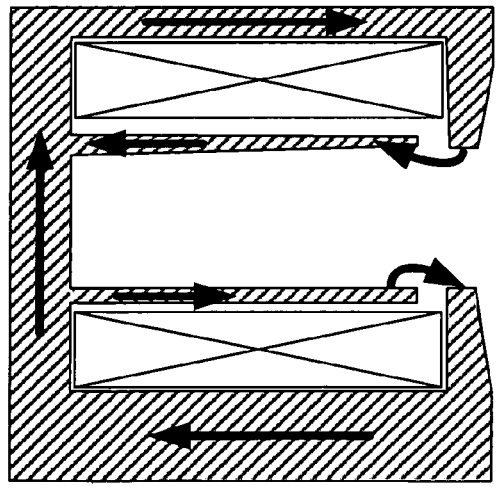
FIG. 4 provides a schematic illustrating an improved magnetic circuit, according to at least one embodiment of the present invention.

A comparison with prior art magnetic circuits is shown in FIGS. 3 and 4. FIG. 3 illustrates a magnetic circuit that produces substantially radial magnetic fields. The outer magnetic source is in the path of the magnetic field, with the arrows illustrating flows. By comparison, the magnetic circuit, illustrated in FIG. 4, produces fields that are both axial and radial. The outer magnetic source is entirely inside the magnetic field path and, unlike prior art circuits, a single integrated circuit is formed.

As discussed above, the magnetic circuit described according to embodiments of the invention offers advantages with respect to performance, beam symmetry and useful lifetime. The magnetic circuit allows for the minimization of the flux of energetic particles to the discharge chamber. The symmetry properties of this magnetic circuit ensures the plasma produced by the Hall effect plasma accelerator will be symmetric, even if the mass of the magnetic circuit is reduced.

Although the invention has been described based upon these preferred embodiments, it would be apparent to those skilled in the art that certain modifications, variations, and alternative constructions would be apparent, while remaining within the spirit and scope of the invention. In order to determine the metes and bounds of the invention, therefore, reference should be made to the appended claims.

The invention claimed is:

1. A Hall effect plasma accelerator comprising:

inner and outer electromagnets, with the outer electromagnet circumferentially surrounding the inner electromagnet along a thruster centerline axis and separated therefrom;

inner and outer magnetic conductors, in physical connection with their respective inner and outer electromagnets, with the inner magnetic conductor having a mostly circular shape and the outer magnetic conductor having a mostly annular shape;

a discharge chamber, located between the inner and outer magnetic conductors;

a magnetically conducting back plate, in magnetic contact with the inner and outer magnetic conductors and securing the relative positions of the inner and outer electromagnets, inner and outer magnetic conductors and the discharge chamber; and a combined anode electrode/gaseous propellant distributor, located at a bottom portion of the discharge chamber, wherein the inner magnetic conductor comprises a magnetic conducting core and an inner pole and the outer magnetic conductor comprises an outer conducting cylindrical portion and an outer pole, and wherein the inner and outer electromagnets, the inner and outer magnetic conductors and the magnetically conducting back plate form a magnetic circuit configured to produce a single axial magnetic field that is uniform with respect to an azimuthal direction and is largely axial within an annular discharge chamber.

2. A Hall effect plasma accelerator comprising:

inner and outer electromagnets, with the outer electromagnet circumferentially surrounding the inner electromagnet along a centerline axis and separated therefrom;

inner and outer magnetic conductors, adjacent to their respective inner and outer electromagnets, with the inner magnetic conductor having a mostly circular shape and the outer magnetic conductor having a mostly annular shape;

a discharge chamber, located between the inner and outer magnetic conductors;

a magnetically conducting back plate, in magnetic contact with the inner and outer magnetic conductors and securing the relative positions of the inner and outer electromagnets, inner and outer magnetic conductors and the discharge chamber; and a combined anode electrode/gaseous propellant distributor, located at a bottom portion of the discharge chamber; and wherein the inner electromagnet, the inner and outer magnetic conductors and the magnetically conducting back plate form a magnetic circuit that produces a magnetic field and wherein the outer electromagnet is continuously annular and is entirely inside the outer magnetic conductor.

3. The Hall effect plasma accelerator of claim 1 or 2, wherein the inner magnetic conductor further comprises an inner annular portion and the outer magnetic conductor further comprises an outer annular portion, where the inner and outer annular portions abut an outer surface of the discharge chamber.

4. The Hall effect plasma accelerator of claims 1 or 2, wherein the discharge chamber comprises an annular trough formed from boron nitride.

5. The Hall effect plasma accelerator of claims 1 or 2, wherein the magnetic field is sufficient to impede transverse motion of plasma toward walls of the discharge chamber during operation of the Hall effect plasma accelerator.

6. The Hall effect plasma accelerator of claims 1 or 2, wherein the magnetic field is sufficient to minimize plasma energy losses to walls of the discharge chamber.

7. A process for operating a Hall effect plasma accelerator, the Hall effect plasma accelerator having an annular discharge chamber in contact with and separating inner and outer magnetic circuit portions, with the inner magnetic circuit portion, the discharge chamber, and the outer magnetic circuit portion being circumferentially arranged around a thruster centerline axis, and the inner and outer magnetic circuit portions comprising a magnetic circuit, the process comprising:

receiving propellant gas through a combined anode electrode/gaseous propellant distributor into the discharge chamber;

forming a plasma in the discharge chamber using the propellant gas; and shaping the formed plasma through a single axial magnetic field produced by the magnetic circuit, wherein the single axial magnetic field is uniform with respect to an azimuthal direction and is largely axial within an annular discharge chamber.

8. The process of claim 7, wherein the shaping of the formed plasma comprises shaping the formed plasma through the single axial magnetic field produced by an inner magnetic conducting core, an inner electromagnet, an inner pole, an outer conducting cylindrical portion, an outer electromagnet, an outer pole and a magnetically conducting back plate.

9. The process of claim 7, wherein the shaping of the formed plasma comprises shaping the formed plasma through the single axial magnetic field produced by an inner magnetic conducting core, an inner electromagnet, an inner pole, an outer conducting cylindrical portion, an outer pole and a magnetically conducting back plate, and an outer electromagnet is not directly in the magnetic circuit.

10. The process of claim 7, wherein the receiving of propellant gas through a combined anode electrode/gaseous propellant distributor into the discharge chamber comprises receiving propellant gas into an annular trough discharge chamber formed from boron nitride.

11. The process of claim 7, wherein the shaping of the formed plasma comprises impeding transverse motion of ions of the formed plasma toward walls of the discharge chamber during operation of the Hall effect plasma accelerator.

12. The process of claim 7, wherein the shaping of the formed plasma comprises minimizing energy losses of ions of the formed plasma to walls of the discharge chamber.

13. The process of claim 7, wherein the shaping of the formed plasma is performed such that a useful lifetime of the Hall effect plasma accelerator is extended in comparison with the Hall effect plasma accelerator operated without the shaping step.

14. A Hall effect plasma accelerator comprising:

annular discharge chamber means for receiving propellant gas and forming a plasma using the propellant gas; and magnetic circuit means for shaping the formed plasma through a single axial magnetic field produced by the magnetic circuit means;

wherein the magnetic circuit means comprises inner and outer the magnetic circuit portions in contact with the annular discharge chamber means, with the annular discharge chamber means separating the inner and outer magnetic circuit portions, with the inner magnetic circuit portion, the discharge chamber, and the outer magnetic circuit portion being circumferentially arranged around a thruster centerline axis, and wherein the produced single axial magnetic field is uniform with respect to an azimuthal direction and is largely axial within an annular discharge chamber.

15. A Hall effect plasma accelerator comprising:

annular discharge chamber means for receiving propellant gas and forming a plasma using the propellant gas; and magnetic circuit means for shaping the formed plasma through a magnetic field produced by the magnetic circuit means;

wherein the magnetic circuit means comprises inner and outer magnetic circuit portions in contact with the annular discharge chamber means, with the annular discharge chamber means separating the inner and outer magnetic circuit portions, with the inner magnetic circuit portion, the discharge chamber, and the outer magnetic circuit portion being circumferentially arranged around a centerline axis, and wherein an outer electromagnet of the Hall effect plasma accelerator is continuously annular and is entirely within the outer magnetic circuit portion.

16. The Hall effect plasma accelerator of claim 14 or 15, wherein the magnetic circuit means comprises an inner magnetic conducting core, an inner electromagnet, an inner pole, an outer conducting cylindrical portion, an outer electromagnet, an outer pole and a magnetically conducting back plate.

17. The Hall effect plasma accelerator of claims 14 or 15, wherein the annular discharge chamber means comprises means for receiving propellant gas into an annular trough discharge chamber formed from boron nitride.

18. The Hall effect plasma accelerator of claims 14 or 15, wherein the magnetic circuit means comprises means for impeding transverse motion of ions of the formed plasma toward walls of the discharge chamber during operation of the Hall effect plasma accelerator.

19. The Hall effect plasma accelerator of claims 14 or 15, wherein the magnetic circuit means comprises means for minimizing energy losses of ions of the formed plasma to walls of the discharge chamber.

* * * * *